United States Patent [19]

Cohn et al.

[11] Patent Number: 4,557,511

[45] Date of Patent: Dec. 10, 1985

[54] LATCH ASSEMBLY FOR HOLDING AN OBJECT IN EITHER OF TWO POSITIONS

[75] Inventors: Robert J. Cohn, Dallas; John J. Chapko, Wilkes-Barre, both of Pa.

[73] Assignee: InterMetro Industries Corp., Wilkes-Barre, Pa.

[21] Appl. No.: 519,320

[22] Filed: Aug. 1, 1983

[51] Int. Cl.[4] ..... E05C 3/14

[52] U.S. Cl. ..... 292/218; 292/238; 312/217

[58] Field of Search ..... 292/230, 238, 302, 304, 292/235, 246, 248–251, 214–217, 213, 218; 312/217, 218, 222

[56] References Cited

U.S. PATENT DOCUMENTS

| | | | |
|---|---|---|---|
| 425,323 | 4/1890 | Hornal | 292/218 |
| 765,593 | 7/1904 | Petersen | 292/218 |
| 876,581 | 1/1908 | Ostul | 292/213 |
| 1,254,882 | 1/1918 | Buchanan | 292/238 |
| 1,892,613 | 12/1932 | Edgin | 292/304 |
| 2,430,311 | 11/1947 | Thiele | 292/246 X |
| 2,912,271 | 11/1959 | Schaefer | 312/222 X |
| 4,474,492 | 10/1984 | Fleitas | 292/304 X |

*Primary Examiner*—Gary L. Smith
*Assistant Examiner*—Lloyd A. Gall
*Attorney, Agent, or Firm*—Fitzpatrick, Cella, Harper & Scinto

[57] ABSTRACT

A latch assembly, for holding an object such as a door in either of two positions, includes a catch mounted in fixed position at each of the positions. A latch is mounted on the object and includes two latch portions, each of which is formed to engage and be trapped by one of the catches upon movement of the object toward one of the positions. A first of the latch portions is manipulable from one side of the object to release the other of the latch portions from its associated catch. Similarly, the other latch portion is manipulable from the other side of the object to release the first portion from its associated catch.

18 Claims, 8 Drawing Figures

LATCH ASSEMBLY FOR HOLDING AN OBJECT IN EITHER OF TWO POSITIONS

BACKGROUND OF THE INVENTION

1. Field of the Invention

The present invention relates to a latch assembly for holding an object in either of two positions. More particularly, this invention relates to such a latch assembly that advantageously may be used to hold, for example, a pivotable door in either its closed position or its open position displaced 180 or 270 degrees from its closed position.

There are many structures in which a simple yet reliable latching mechanism is desirable for holding a closure like a door in either an open or a closed position. For example, delivery/storage cabinets used to transport and store food trays in bakeries or food service institutions typically have a door mounted for pivoted movement between a closed position retaining the trays in the cabinet interior, and an open position providing access to the interior. (A food service institution is generally understood to be one, such as a restaurant, cafeteria, school lunch facility or the like, in which food is prepared to be taken out or consumed on the premises.) When swung to the closed position, the door should automatically and positively latch in order to prevent the trays from falling out of the cabinet. Similarly, when swung to the open position, the door should also automatically and positively latch so as not to interfere with removal of trays from or return to the cabinet interior and so as not to obstruct the area in which the cabinet may temporarily be located. Furthermore, for convenience of the user, the latch assembly should be manipulable with one hand to release the door from either the latched open or the latched closed position.

Of course, there are many other applications for a simple latch assembly that holds an object in either of two positions and that may be conveniently manipulated to release the object from those positions.

2. Description of the Prior Art

Many types of latches for securing a door in an open or a closed position are presently known. Some operate under the influence of gravity to move to a latched condition while others incorporate a mechanism such as a spring for this purpose.

For example, storage and transport cabinets sold under the name CRES-COR by Crescent Metal Products, Inc., 12711 Taft, Cleveland, Oh. 44108, and denoted 100 Series, 100-SD Series, 150 Series, 101 Series, 101-MP, 100-MP, 101-MM Series, and 115-AP Series, incorporate a latch mounted on the cabinet, not on the cabinet door, that tends to move to the latched condition under the influence of gravity. However, in operation the latch is first moved manually to an unlatched position prior to latching operation.

Mobile cabinets available from Normandie, 133-14 Jamaica Avenue, Richmond Hill, N.Y., 11418, incorporate a latch similar to that used on the Crescent Metal Products cabinets.

Cabinets sold under the name TRANSITRAY CABINET, by Bevles Company, Inc., 2121 Central Avenue, South El Monte, Calif. 91733, incorporate a gravity operated latch. However, it is believed that this latch must be manipulated to secure the door in either the open or closed position.

Thus, latches known in the art such as those briefly discussed above are characterized by certain drawbacks.

SUMMARY OF THE INVENTION

The present invention relates to a latch assembly for holding an object such as a swingable door in one of two or more positions wherein when moved to any of the positions, the latch assembly automatically assumes a latched attitude.

This invention contemplates a latch assembly that includes a single latch member mounted on the object and operable under the influence of gravity to assume a latched attitude and manipulable from either side of the object to be released from the latched attitude in either of the positions in which the object is held.

The present invention also provides a latch assembly in which portions of the latch member for holding the object in one position from one side thereof are concealed from the other side of the object. Therefore, this latch assembly is exceedingly attractive as well as simple and convenient to use.

The latch assembly of the present invention may advantageously be used, for example, in conjunction with a door on a delivery/storage cabinet for storing and transporting trays of food in bakeries or food service institutions. However, this latch assembly also may advantageously be used with any moveable object such as a door, a gate, or a pivotable window, in which it is desirable to easily and automatically hold the object in either of two positions.

In accordance with the preferred embodiments, the latch assembly of the present invention includes an open-position catch mounted at the open position of the object and a closed-position catch mounted at the closed position of the object. Each catch has an inclined or a cam surface that terminates in a trapping surface. A latch is mounted for limited pivoted movement on the object between a normally latched attitude, assumed under the influence of gravity, and an unlatched attitude. The latch member has an open-position latch portion that defines a trapped surface engageble with the cam surface of the open-position catch during an initial portion of movement of the object toward the one position to pivot the latch member toward the unlatched attitude. The open-position latch portion disengages from the cam surface upon final movement of the object to the one position, thereby permitting the latch member to move toward its latch attitude with the trapping and trapped surfaces abutting one another.

The latch member also has a closed-position latch portion that defines a trapped surface engageable with the cam and trapping surfaces of the closed-position catch in a manner similar to interengagement of the open-position latch portion and catch.

The open-position latch portion is manipulable from one side of the object to move the latch member to the unlatched attitude for release from the open-position catch. The closed-position latch portion similarly is manipulable from the other side of the object also to move the latch member to the unlatched attitude for release from the closed-position catch.

In the preferred embodiments, the latch member is mounted with the object so that the respective latch portions may only be seen on the side of the object from which they are manipulable. That is, the open-position latch portion is manipulable from one side of the object but is concealed from view from the other side of the object. Accordingly, the latch assembly of the invention has a pleasing appearance and at the same time is convenient and simple to operate.

Thus, the present invention provides a simple and aesthetically and mechanically elegant latch assembly that automatically operates to capture and hold an object in either one of two positions yet may be easily operated to release the object from either of these positions.

These and other objects, aspects and advantages of the present invention will be pointed out in or will be understood from the detailed description provided below in conjunction with the accompanying drawing.

DETAILED DESCRIPTION OF THE PREFERRED EMBODIMENTS

In its preferred embodiments, the latch assembly of the present invention is specifically designed to secure the swingable or pivotable door of a delivery/storage cabinet in either an open or a closed position. Therefore, for convenience the latch assembly will be described in this environment. However, it will be readily appreciated by those skilled in the art that the latch assembly of the invention may be adapted to any of a myriad of applications in which any object such as a door, a gate, or a swingable window is desirably held in one of two or more positions.

Figure 1:
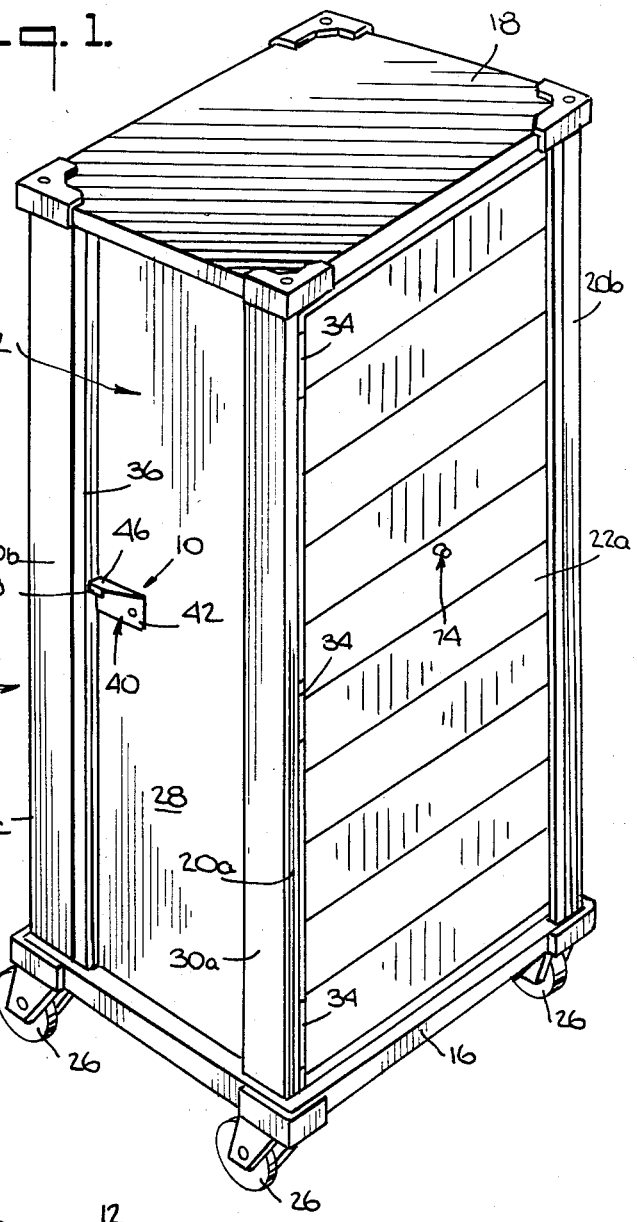
FIG. 1 is a perspective view of a delivery/storage cabinet, for transporting and storing trays, that incorporates the latch assembly of the present invention for holding the cabinet door in either the open or the closed position.

Referring first to FIG. 1, the latch assembly of the present invention is generally indicated at 10 and is used in conjunction with the door 12 of a delivery/storage cabinet generally indicated at 14. In addition to the door, the cabinet may have a base 16, a top 18, four corner posts 20, and two mutually parallel side walls 22 extending between pairs of the corner posts and recessed from their lateral extremes. A spreader bar 38 (shown in FIGS. 2 and 4) may span the distance between the two forward corner posts **20*a* and 20*c*, which define the front opening of the cabinet, in order to add rigidity to the structure. As is well known, the inner surfaces of the side walls may be provided with supports for trays. The cabinet also includes a back wall (not shown) that opposes the front opening. For convenience, the entire cabinet may be mounted on casters 26** to ease its movement.

As shown in FIGS. 1 through 4, the door 12 is formed with a relatively wide, generally flat central panel 28 and a pair of opposing narrower but also generally flat edge panels 30 that are mutually parallel to the central panel 28. Each edge panel 30 is integrally joined to and offset from the central panel 28 by an intermediate wall 32 extending perpendicularly to both. An extruded handle 36 may be mounted on the door 12 adjacent the left intermediate wall **32*a* to assist opening of the door, but may be eliminated if desired. As shown in FIG. 1, the right edge panel 30*a* is attached to the movable portion of a hinge 34, having a fixed portion secured to the right, forward corner post 20*a*. Accordingly, the door 12 may swing through about 270 degrees between the closed position shown in FIG. 1 and an open position lying closely against the right side wall 22*a* and recessed between the two right corner posts 20*a* and 20*b***.

The latch assembly 10 in accordance with the first embodiment of the present invention includes a latch member generally indicated at 40 comprising an enlarged plate 42 pivotably mounted on a shaft 44 that is secured to the central panel 28 of the door 12. A flange 46 projects forwardly from the upper extreme of the plate 42 and a flat grab handle 48, which also constitutes a open-position latch portion as will be described in greater detail below, depends from the forward extreme of the flange 46.

The left intermediate wall 32 of the door 12 is formed with a vertically extending slot 50 at its juncture with the central panel 28 and the latch member is formed with a leftwardly projecting arm 52 that passes through the slot. The opposed vertical extremes of the slot limit the range of pivoted movement of the latch member about the shaft 44 and the lower extreme supports the latch member against the influence of gravity near its normal, latched attitude.

Figure 3:
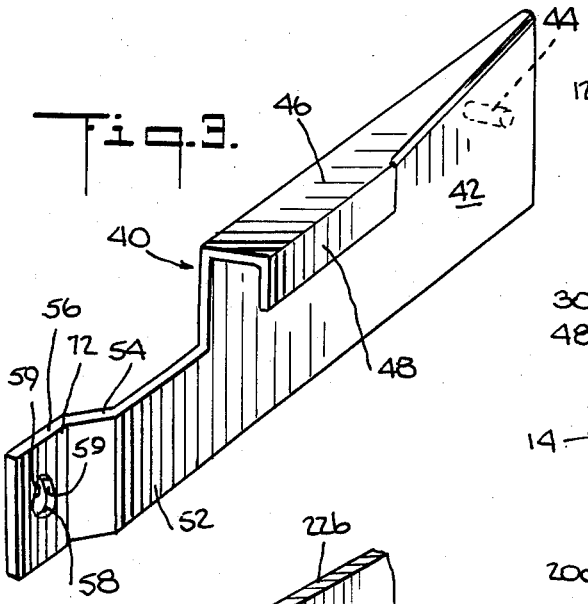
FIG. 3 is a perspective view of the latch member removed from the cabinet door.
Figure 2:
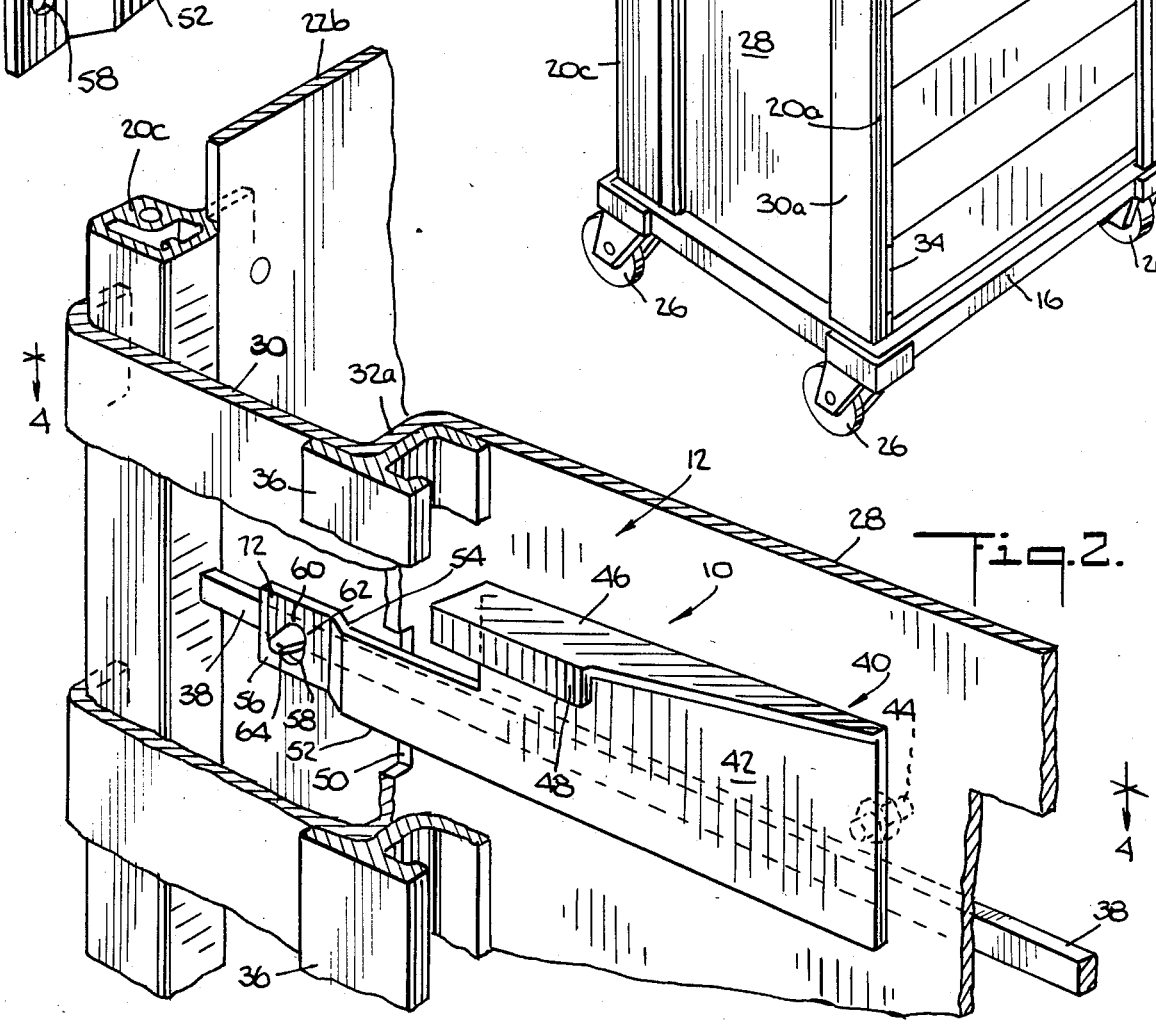
FIG. 2 is an enlarged perspective view of a portion of the door and latch assembly in the closed position with part of the door broken away to show engagement of the latch member with the closed-position catch.

The arm 52 of the latch member 40 includes a short section 54 extending obliquely to the plate 42 and terminating in a closed-position latch portion 56 extending parallel to the plate 42. As can be seen in FIGS. 2 and 3, the portion 56 is formed with a tear-drop shaped hole 58 having a large diameter part at the bottom and a small diameter part at the top thereby defining inverted V-shape side walls 59.

Figure 4:
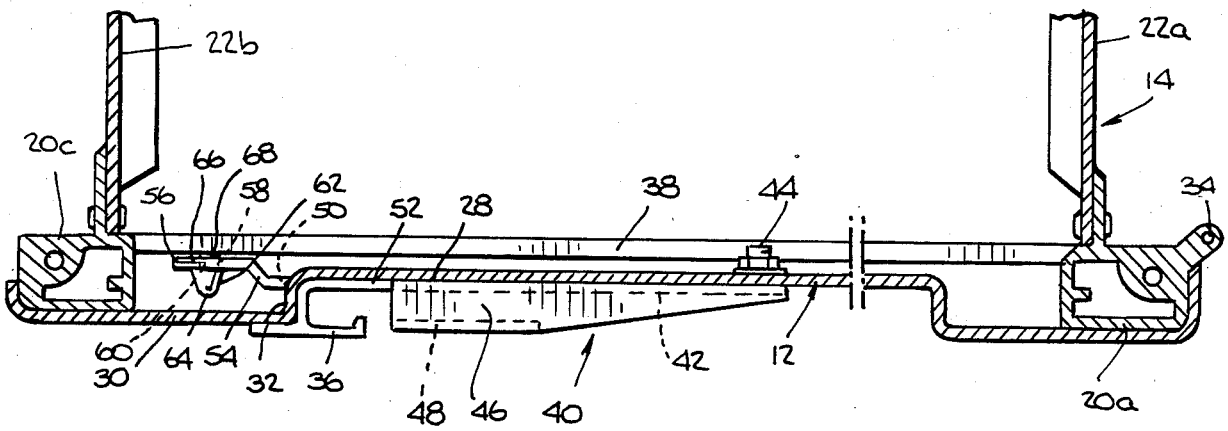
FIG. 4 is a horizontal cross-sectional view taken on plane 4—4 in FIG. 2 looking downwardly and showing the engaged latch member and closed-position catch.

As shown in detail in FIGS. 2 and 4, a closed-position catch 60 is formed with a conical head 62 having a rounded nose 64 and that terminates in a generally flat trapping surface 66. A stem 68 projects axially from the center of the trapping surface and is secured to the spreader bar 38 by a screw, rivet, or other suitable means at a position opposing the hole 58 through the closed-position latch portion 56 of the latch member. The diameter of the larger portion of the hole 58 is greater than the largest diameter of the head 62 of the catch 60. However, the diameter of the small portion of the hole is approximately equal to the diameter of the stem 68. Accordingly, when the door 12 is initially moved toward its closed position shown in FIGS. 1, 2, and 4, the closed-position latch portion 56 of the latch member will engage the catch member with the inverted V-shape side walls 59 of the hole 58 engaging and, through camming action, riding up on the conical surface of the head 62 of the catch 60. The camming action continues until the outwardly facing or trapped surface 72 of the closed-position latch portion is disengaged from the head of the closed-position catch. At this time, the latch member returns to its normal latched attitude under the influence of gravity with a part of the trapped surface 72 adjacent the V-shaped walls 59 in abutting relation with the trapping surface 66 of the catch 60. Therefore, the door will be retained in the closed position by engagement of the catch and latch member.

When it is desired to release the latching engagement of the catch and latch members 60 and 40, the latch member need only be pivoted to its unlatched attitude by manipulating the grab handle 48 and flange 46 until the large diameter portion of the hole 58 registers with the head 62 of the catch member. The door may then be moved away from the closed position with the catch head passing through the hole in the latch member. Manipulation of the grab handle and flange may be with only one of the user's hands.

Thus, the latch assembly of the present invention is automatically operable upon movement of the door toward its closed position to trap the door there. The latch assembly is also easily operable with one hand to release the trapping engagement holding the door in this position.

Figure 5:
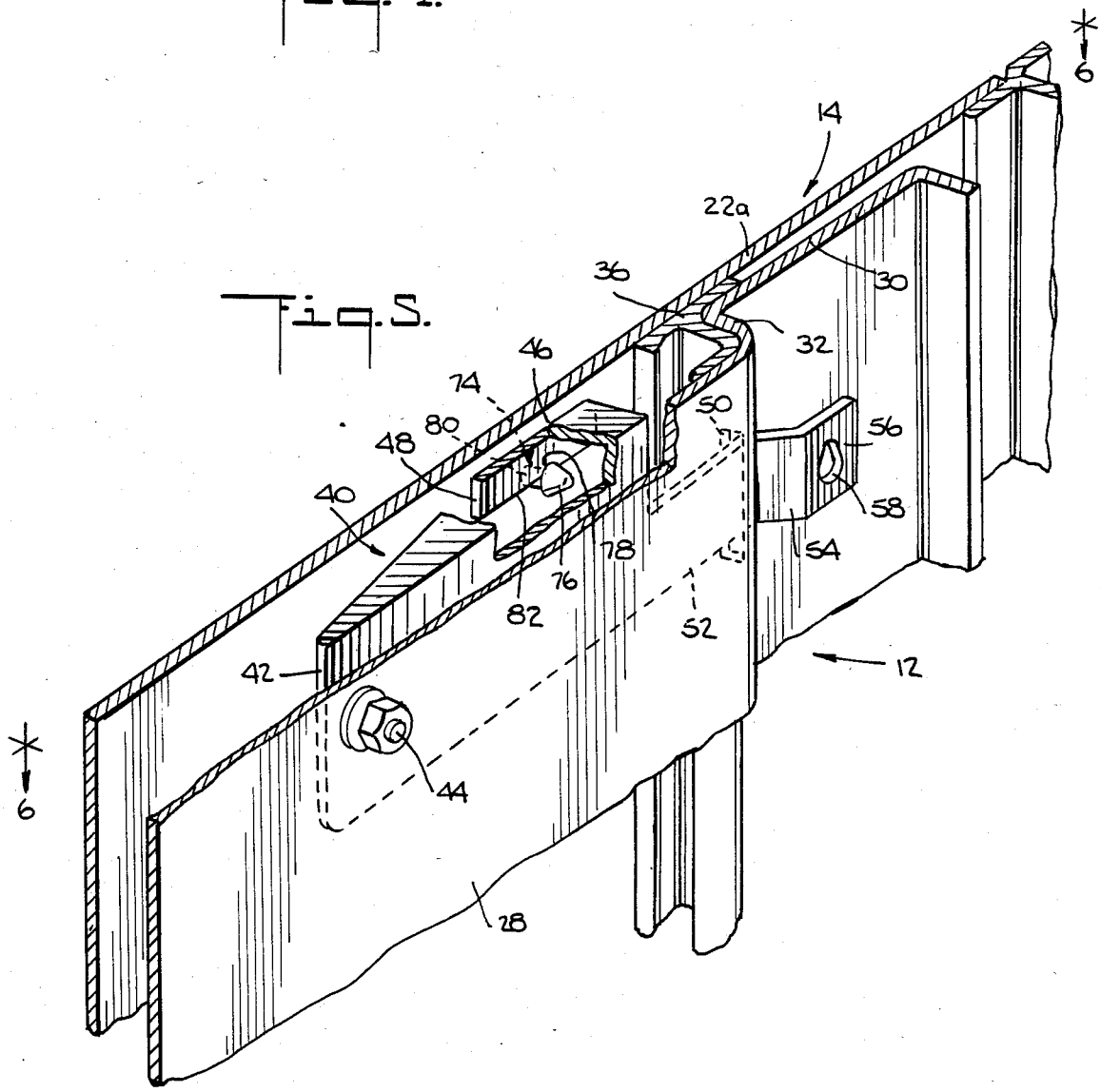
FIG. 5 is an enlarged perspective view of a portion of the door and the latch assembly in the open position with part of the door and latch member broken away to show engagement of the closed-position portion of the latch member with the closed-position catch.
Figure 6:
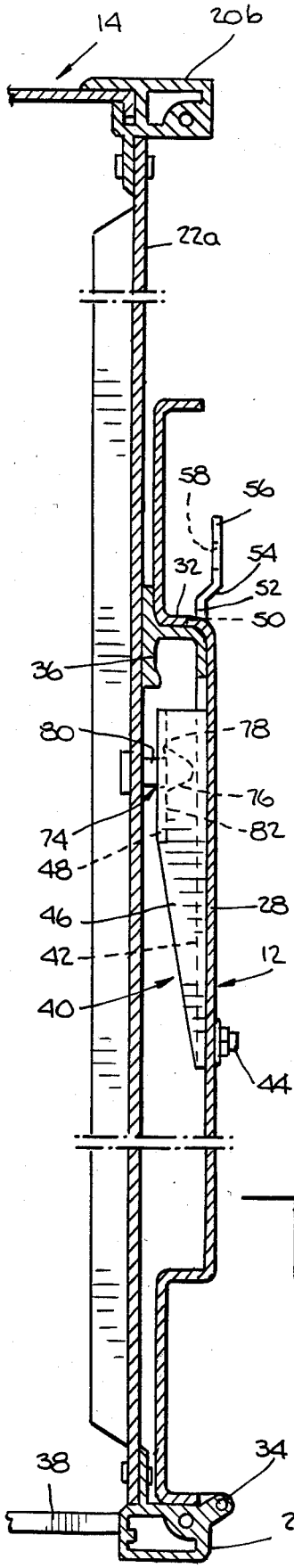
FIG. 6 is a horizontal cross-sectional view taken on plane 6—6 in FIG. 5 looking downwardly.

Referring now to FIGS. 5 and 6, it can be seen that in addition to providing a manipulable structure for releasing the latch member when the door is trapped in its closed position, the grab handle 48 acts as an open-position latch portion that in cooperation with an open position catch 74 holds the door in its open position. The open-position catch 74 is identical to the closed-position catch 60 and is mounted by having its stem 80 bolted, riveted or otherwise secured to the right side wall 22*a* of the cabinet at a position to engage the grab handle. Upon movement of the door toward its open position, the lower edge of the grab handle engages the conical cam surface of the open-position catch head 76 causing the latch member to pivot upwardly about the shaft 44. When the door is moved sufficiently toward its open position to disengage an inner trapped surface 82 of the grab handle 48 from the cam surface, the latch member will pivot under the influence of gravity to its normal latched attitude with the trapped surface in engagement with the trapping surface 78 of the open-position catch. At this time the door is positively held in its open position.

FIGS. 5 and 6 also show that the closed-position latch portion 56 of the latch is accessable from the inside of the door so that it may be manipulated when the door is latched in its open position to release engagement of the trapped and trapping surfaces.

As can be seen further in the Figures, the closed-position latch portion 56 of the latch member is concealed from view by the left edge panel 30*b* of the door when the door is in its closed position. Similarly, when the door is in its open position, the open-position latch portion or grab handle 48 is concealed from view by the central panel 28 of the door. Therefore, in both positions of the door, the latch assembly of the present invention provides a clean and pleasing appearance.

Figure 7:
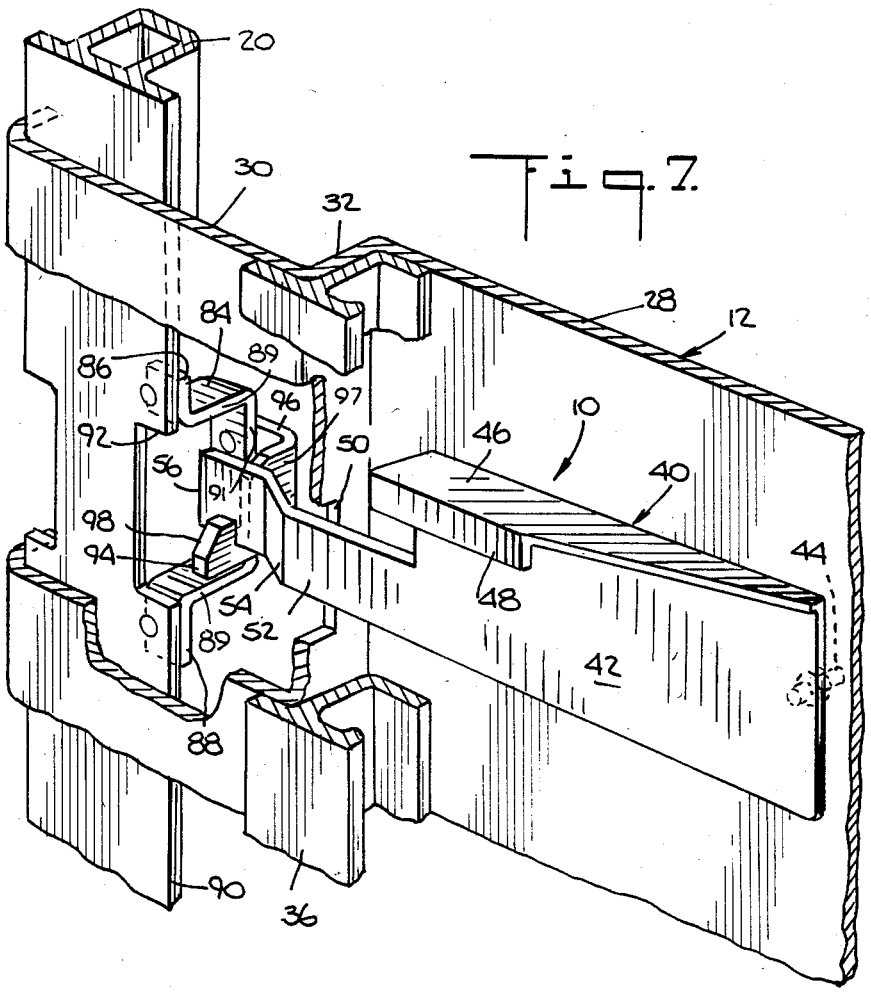
FIG. 7 is a perspective view of the latch member engaged by an alternative catch structure with the door in the closed position.
Figure 8:
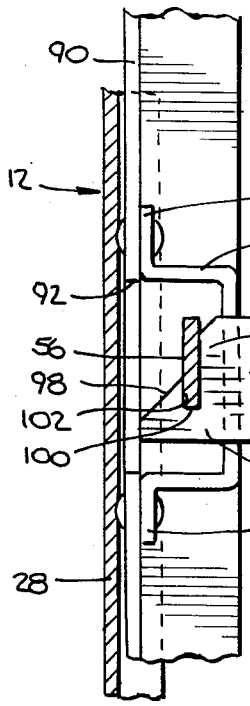
FIG. 8 is a side elevational view of the alternative catch structure.

As shown in FIGS. 7 and 8, an alternative catch may be utilized in the latch assembly of the present invention particularly, though not neccessarily, in applications were the spreader bar is not needed or undesirable. This alternative catch includes a C-shaped mounting bracket 84 having upwardly and downwardly directed flanges 86 and 88 extending from the extremes of the legs 89 thereof. The flanges may be secured to a plate 90 projecting sidewardly from a corner post 20, that is formed with a notch 92 for exposing the base 91 of the mounting bracket 84.

The alternative catch also includes a catch member 94 having a base 96 secured by rivets or other suitable fastener means to the base of the mounting bracket 84. A strike plate 97 of this catch member projecting forwardly from the base is wedge-shaped, having an inclined cam surface 98 that terminates in a slot 100 having a rearwardly facing trapping surface 102. The catch member is positioned so that the lower edge of the closed-position latch portion 56 of the latch member engages the lower-most region of the inclined surface 98 upon initial movement of the door toward its closed position. Accordingly, the latch member is pivoted upwardly until the closed-position latch portion registers with the notch and the latch member may return to its latched attitude under the influence of gravity with the trapping surface 102 in abutting engagement with the trapped surface of the closed-position latch portion.

The latch member is operated in the same way as was described with reference to the first embodiment to release it from the latched condition.

A similar alternative catch member may be mounted on the side wall 22*a* replacing the open-position catch shown in FIGS. 5 and 6. The open-position latch portion defined by the grab handle 48 engages this catch member by registering with the notch 100 to latch the door in its open position.

It will be appreciated from the above description that the present invention provides a simple, aesthetically and mechanically elegant latch assembly for securing an object such as a door in either one of two positions. This latch assembly is easily operable with one hand to release latching engagement of the object from either of its two positions, and is automatically operable upon movement of the object toward either of the two positions to effect latching engagement.

Accordingly, although preferred embodiments of the present invention have been described above in detail, it is to be understood that this is for purposes of illustration. Modifications may be made to these embodiments in order to adapt the latch assembly of the present invention to particular applications.

What is claimed is:

1. A latch and object assembly comprising:

an object mounted for movement between two positions and having two sides;

first catch means mounted in the region of one of said positions of said object;

second catch means mounted in the region of the other of said positions of said object; and a latch member mounted on said object and having a first latch portion engageable with said first catch means to hold said object in said one position and a second latch portion engageable with said second catch means to hold said object in said other position; said first latch portion including means manipulable from one side of said object to release holding engagement of said second latch portion and said second catch means, and said second latch portion including means manipulable from another side of said object to release holding engagement of said first latch portion and said first catch means;

said object further comprising first concealing means for obstructing view of said first latch portion when said object is in said one position, and second concealing means for obstructing view of said second latch means when said object is in said other position.

2. A latch and object assembly according to claim 1, wherein said object is formed with a slot and wherein said latch member further comprises an intermediate section joining said first and said second latch portions and projecting through said slot.

3. A latch and object assembly according to claim 2, wherein said object comprises a first panel, a second panel generally parallel to said first panel and a wall extending generally perpendicularly to and connecting said first and second panels, said latch member being mounted for pivoted movement on said first panel, said slot being formed in said wall with said intermediate section projecting therethrough and engageable at the extremes thereof by said intermediate section to limit pivoted movement of said latch member, said second panel comprising said second concealing means obstructing view of said second latch portion from said one side of said object and said first panel comprising said first concealing means obstructing view of said first latch portion from said other side of said object.

4. A latch and object assembly according to claim 1, wherein said latch member comprises a main plate and one of said latch portions comprises a flange projecting outwardly from said plate and a handle depending from said flange, said flange and said handle comprising said first latch portion manipulable means.

5. A latch and object assembly according to claim 1, wherein said latch member is pivotable between a normally latched attitude and an unlatched attitude, wherein said first and said second catch means each comprise a cam surface terminating in a trapping surface and wherein said first and second latch portions each define a trapped surface engageable with one of said cam surfaces upon initial movement of said object toward the associated position to pivot said latch member toward said unlatched attitude and subsequently disengageable from said cam surface upon final movement of said object toward said associated position to permit said latch member to move toward its latched attitude with said trapping and trapped surfaces in engagement.

6. A latch and object assembly according to claim 5, wherein at least one of said first and said second catch means comprises a strike plate having an inclined edge defining said cam surface and terminating in a slot defining said trapping surface.

7. A latch and object assembly according to claim 5, wherein at least one said first and said second catch means comprises a head portion having a conical outer surface defining said cam surface and terminating in said trapping surface, and a stem projecting from said trapping surface for attachment to a fixed structure in the region of one of said two positions.

8. A latch and object assembly according to claim 7, wherein at least one of said first and said second latch portions comprises an arm formed with an aperture therein, a part of which is of sufficiently large diameter to pass over said main body and a smaller part of which embraces said stem with adjacent portions of said arm, defining said trapped surface, confronting said trapping surface.

9. A latch and object assembly according to claim 1, wherein said object comprises a first panel, a second panel generally parallel to said first panel, and a wall extending generally perpendicularly to and connecting said first and said second panels, said wall being formed with an opening therein, said latch member being mounted for pivoted movement on said first panel and projecting through said opening with said second latch portion located adjacent said second panel which thereby comprises said second concealing means and with said first latch portion located adjacent said first panel which thereby comprises said first concealing means.

10. A latch and object assembly comprising:

an object mounted for movement between at least two positions;

first catch means mounted in the region of a first of said positions of said object and having a first cam surface terminating in a first trapping surface;

second catch means mounted in the region of a second of said positions of said object and having a second cam surface terminating in a second trapping surface; and a latch member mounted for limited pivoted movement on said object between a normally latched attitude and an unlatched attitude, said latch member having a first latch portion, defining a first trapped surface, engageable with said first cam surface upon initial movement of the object toward said first position to pivot said latch member toward said unlatched attitude and subsequently disengageable from said first cam surface upon final movement of said object to said first position to permit said latch member to move toward its latched attitude with said first trapped surface engaging said first trapping surface; said latch member also having a second latch portion, defining a second trapped surface, engageable with said second cam surface upon initial movement of the object toward said second position to pivot said latch member toward said unlatched attitude and subsequently disengageable from said second cam surface upon final movement of said object to said second position to permit said latch member to move toward its latched attitude with said second trapped surface engaging said second trapping surface;

said object further comprising first concealing means for obstructing view of said first latch portion when said object is in said first position, and second concealing means for obstructing view of said second latch portion when said object is in said second position.

11. A latch and object assembly according to claim 10, wherein said first latch portion comprises means manipulable from one side of said object to move said latch member to said unlatched attitude, and wherein said second latch portion comprises means manipulable from a side of said object opposite said one side also to move said latch member to said unlatched attitude.

12. A latch and object assembly according to claim 11, wherein said latch member comprises a main plate and said first latch portion comprises a flange projecting outwardly from said plate and a handle depending from said flange, said flange and said handle comprising said first latch portion manipulable means.

13. A latch and object assembly according to claim 11, wherein said object is formed with a slot and wherein said first latch portion manipulable means is joined to said second latch portion manipulable means by an intermediate section projecting through said slot.

14. A latch and object assembly according to claim 10, wherein at least one of said first and said second catch means comprises a head portion having a conical outer surface defining said cam surface and terminating in said trapping surface, and a stem projecting from said trapping surface for attachment to a fixed structure in the region of one of said two positions.

15. A latch and object assembly according to claim 14, wherein at least one of said first and said second latch portions comprises an arm formed with an aperture therein, a part of which is of sufficiently large diameter to pass over said head and a smaller part of which embraces said stem with adjacent portions of said arm defining said trapped surface, engageable with said trapping surface.

16. A latch and object assembly according to claim 10, wherein at least one of said first and said second catch means comprises a strike plate having an inclined edge defining said cam surface and terminating in a slot defining said trapping surface.

17. A latch and object assembly according to claim 10, wherein said object comprises a first panel, a second panel generally parallel to said first panel and a wall extending generally perpendicularly to and connecting said first and said second panels, said wall being formed with an opening therein, said latch member being mounted for pivoted movement on said first panel and projecting through said opening with said second latch portion located adjacent said second panel which thereby comprises said second concealing means and with said first latch portion located adjacent said first panel which thereby comprises said first concealing means.

18. A latch and object assembly comprising:

an object mounted for movement between two positions and having two sides;

first catch means mounted in the region of one of said positions of said object;

second catch means mounted in the region of the other of said positions of said object; and a latch member mounted on said object and having a first latch portion engageable with said first catch means to hold said object in said one position and a second latch portion engageable with said second catch means to hold said object in said other position; said first latch portion including means manipulable from one side of said object to release holding engagement of said second latch portion and said second catch means, and said second latch portion including means manipulable from another side of said object to release holding engagement of said first latch portion and said first catch means;

said object further comprising a first panel, a second panel generally parallel to said first panel and a wall extending generally perpendicular to and connecting said first and said second panels, said wall being formed with an opening therein, said latch member being mounted for pivoted movement on said first panel and projecting through said opening with said second latch portion located adjacent said second panel which thereby obstructs view of said second latch portion when said object is in said other position and with said first latch portion located adjacent said first panel which thereby obstructs view of said first latch portion when said object is in said one position.

* * * * *